US009512995B2

(12) United States Patent
Wandrey et al.

(10) Patent No.: US 9,512,995 B2
(45) Date of Patent: Dec. 6, 2016

(54) LED RING ASSEMBLY

(71) Applicant: Sternberg Lighting, Roselle, IL (US)

(72) Inventors: John Wandrey, Mount Prospect, IL (US); Steve Walczak, Kenosha, WI (US)

(73) Assignee: Sternberg Lighting, Roselle, IL (US)

( * ) Notice: Subject to any disclaimer, the term of this patent is extended or adjusted under 35 U.S.C. 154(b) by 0 days.

(21) Appl. No.: 14/592,032

(22) Filed: Jan. 8, 2015

(65) Prior Publication Data

US 2016/0201891 A1 Jul. 14, 2016

(51) Int. Cl.

| | |
|---|---|
| ***F21V 29/503*** | (2015.01) |
| ***F21V 29/71*** | (2015.01) |
| ***F21V 29/76*** | (2015.01) |
| ***F21V 13/04*** | (2006.01) |
| ***F21V 29/51*** | (2015.01) |
| *F21V 31/00* | (2006.01) |
| *F21V 7/00* | (2006.01) |

(52) U.S. Cl.

CPC ..... *F21V 29/503* (2015.01); *F21V 13/04* (2013.01); *F21V 29/51* (2015.01); *F21V 29/717* (2015.01); *F21V 29/76* (2015.01); *F21V 7/0008* (2013.01); *F21V 29/763* (2015.01); *F21V 31/005* (2013.01); *F21Y 2115/10* (2016.08)

(58) Field of Classification Search

CPC .. F21V 29/006; F21V 29/507; F21V 29/503; F21V 29/20; F21V 29/2212; F21V 29/74; F21V 29/717; F21V 13/04; F21V 29/506; F21V 29/70; F21V 29/76; F21Y 2103/003; F21Y 2105/001

USPC ..... 362/217.01, 217.02, 217.04, 217.1, 362/217.12–217.17, 218, 219, 222, 223, 362/225, 227, 240, 244, 246, 249.01, 362/249.02, 249.11, 282, 285, 294, 309, 362/310, 326, 327, 335, 351, 362, 365, 370, 362/373–375, 395, 396, 410, 431, 432, 800

See application file for complete search history.

(56) References Cited

U.S. PATENT DOCUMENTS

| | | | | |
|---|---|---|---|---|
| 8,434,893 | B2 * | 5/2013 | Boyer | F21V 7/04 362/240 |
| 8,444,297 | B2 * | 5/2013 | Lee | F21S 8/086 362/249.02 |
| 8,622,574 | B2 * | 1/2014 | Liu | F21S 2/005 362/241 |
| 2009/0323343 | A1 * | 12/2009 | Wang | F21S 8/086 362/249.11 |
| 2010/0073642 | A1 * | 3/2010 | Sueoka | F21V 29/004 353/54 |
| 2010/0135011 | A1 * | 6/2010 | Richardson | F21S 8/086 362/234 |
| 2011/0261567 | A1 * | 10/2011 | Lee | F21S 8/086 362/249.03 |

(Continued)

FOREIGN PATENT DOCUMENTS

| | | |
|---|---|---|
| CN | 203731253 U | 7/2014 |
| DE | 202009008456 U1 | 8/2009 |

OTHER PUBLICATIONS

Canadian Patent Office, Examination Report, dated Aug. 15, 2016; 4 pages.

*Primary Examiner* — Hargobind S Sawhney
(74) *Attorney, Agent, or Firm* — Seyfarth Shaw LLP

(57) ABSTRACT

Disclosed is a lighting device that includes a heat sink coupled to a heat dissipation structure. The heat dissipation structure can include heat conduits operatively coupled to the LED to receive and emit heat from the LED. The heat conduits conduct heat from the LED to the heat sink that is distally disposed relative to the LED to protect the internal components of the lighting device.

16 Claims, 4 Drawing Sheets

(56) References Cited

U.S. PATENT DOCUMENTS

2012/0099319 A1* 4/2012 Liu ..... F21S 2/005
362/249.02
2012/0211201 A1* 8/2012 Kunstwadl ..... F21V 29/004
165/104.21
2012/0307496 A1* 12/2012 Phillips, III ..... F21V 5/04
362/245
2013/0027935 A1* 1/2013 Ladewig ..... F21S 2/00
362/249.01
2013/0088871 A1* 4/2013 Yun ..... F21S 4/28
362/249.01
2013/0194800 A1* 8/2013 Boyer ..... F21V 7/04
362/241
2014/0211470 A1* 7/2014 Kinnune ..... F21S 8/086
362/249.02
2015/0023020 A1* 1/2015 Gattari ..... F21S 8/086
362/282
2016/0003465 A1* 1/2016 Roh ..... F21S 8/086
362/235

* cited by examiner

LED RING ASSEMBLY

TECHNICAL FIELD OF THE INVENTION

The present application relates generally to heat dissipation systems. More particularly, the present application relates to an LED assembly that efficiently dissipates heat from the LED.

BACKGROUND OF THE INVENTION

Light emitting diodes ("LEDs") are energy efficient devices that emit light. LEDs are typically more durable and require less power than conventional lighting technology, making them ideal for lights that are frequently in use, such as, for example, street lights. However, LEDs generally produce heat as a by-product of light production and such heat can damage the surrounding structure or LED if it not effectively dissipated.

Currently, LED heat dissipation assemblies include a heat sink with, for example, fins that dissipate the heat from the lighting device to the environment. The heat sink is typically connected to the LED so heat can be conducted directly or indirectly from the LED to the heat sink, and ultimately, away from the lighting device.

Conventional heat dissipation assemblies require direct or near direct connection between the heat sink and LED to effectively receive and dissipate the heat. The heat sink must also be exposed to the outside atmosphere to disperse the excess heat away from the LED device, thus causing concerns of corrosion and the like. These spatial constraints, in addition to the necessary bulk of the heat sink, limit the locations for other parts of the LED device and inefficiently dissipate heat.

SUMMARY OF THE INVENTION

The present application discloses a lighting device that includes a heat sink coupled to a heat dissipation structure. The heat dissipation structure can include an extension portion with heat conduits that are operatively connected to the LED to receive and emit heat from the LED. The heat conduits efficiently conduct heat from the LED to the heat sink, which then emits the heat away from the lighting device, so as to protect the internal components of the lighting device, while still enabling distal placement of the heat sink relative to the LED.

In particular, the present application discloses a lighting device including a light emitting structure, a housing adapted to house the light emitting structure, a reflector disposed within the housing and adapted to reflect light emitted from the light emitting structure, and a heat dissipation structure coupled to the housing and including a heat conduit operatively coupled to the light emitting structure to receive heat therefrom, and a heat sink distally disposed relative to the light emitting structure and operatively coupled to the heat conduit to receive the heat therefrom and to dispense the heat away from the light emitting structure.

Also disclosed is a heat dissipation structure including a cap, an extension portion extending from the cap, a body extending from the extension portion, a light emitting device coupled to the cap, a heat conduit operatively coupled to the light emitting device and adapted to transfer heat away from the light emitting device, and a heat sink distally disposed relative to the light emitting device and operatively coupled to the heat conduit and adapted to receive heat from the heat conduit and dispense the heat away from the heat dissipation structure.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
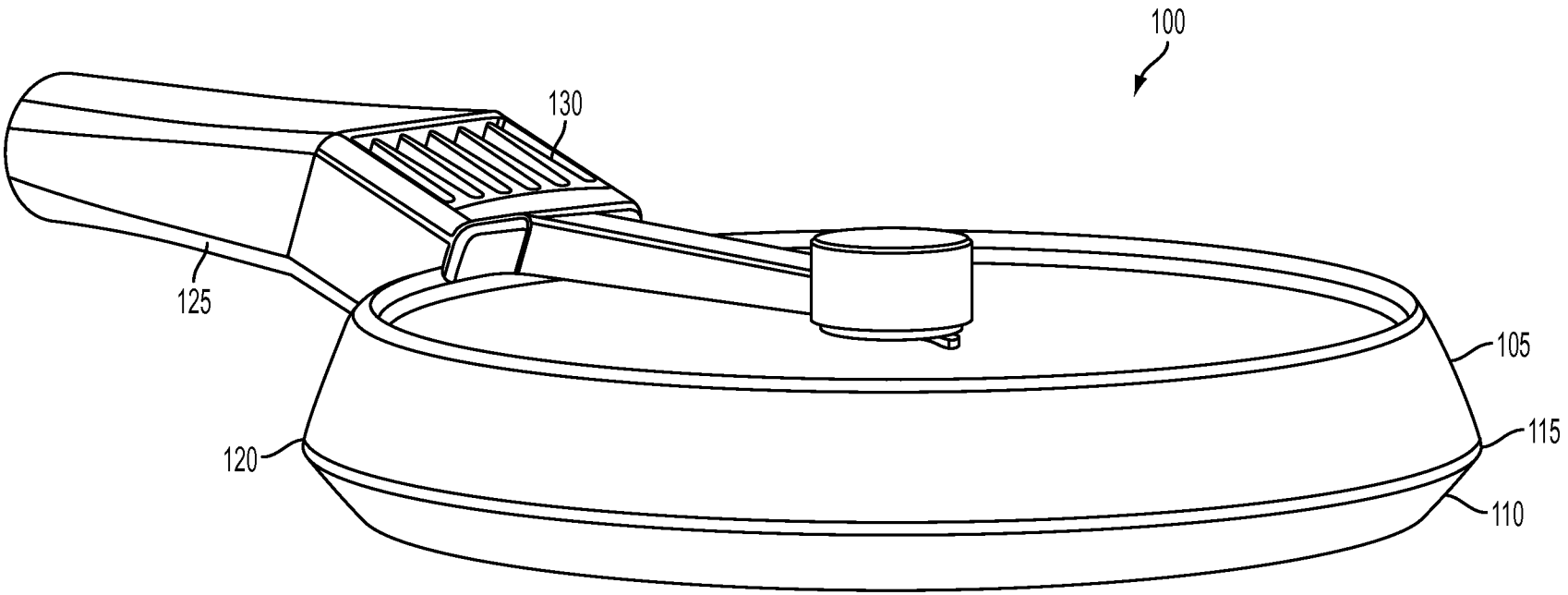
FIG. 1 is a perspective view of a lighting device according to an embodiment of the present application.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated.

The present application discloses a lighting device that includes a heat sink operatively connected to and distally disposed relative to an LED. The heat generated through operation of the LED is transferred to the heat sink through one or more heat conduits to allow greater spatial variability of the lighting device and protect the internal components of the lighting device.

As shown in FIG. 1, a lighting device 100 is shown and can include an upper housing 105, a lower housing 110, and an upper gasket 115 and a lower gasket 120 sandwiched between the upper housing 105 and the lower housing 110. The lighting device 100 can also include a heat dissipation structure 125 that receives heat from the lighting device 100 and emits it away from the lighting device 100 via the heat sink 130.

Figure 2:
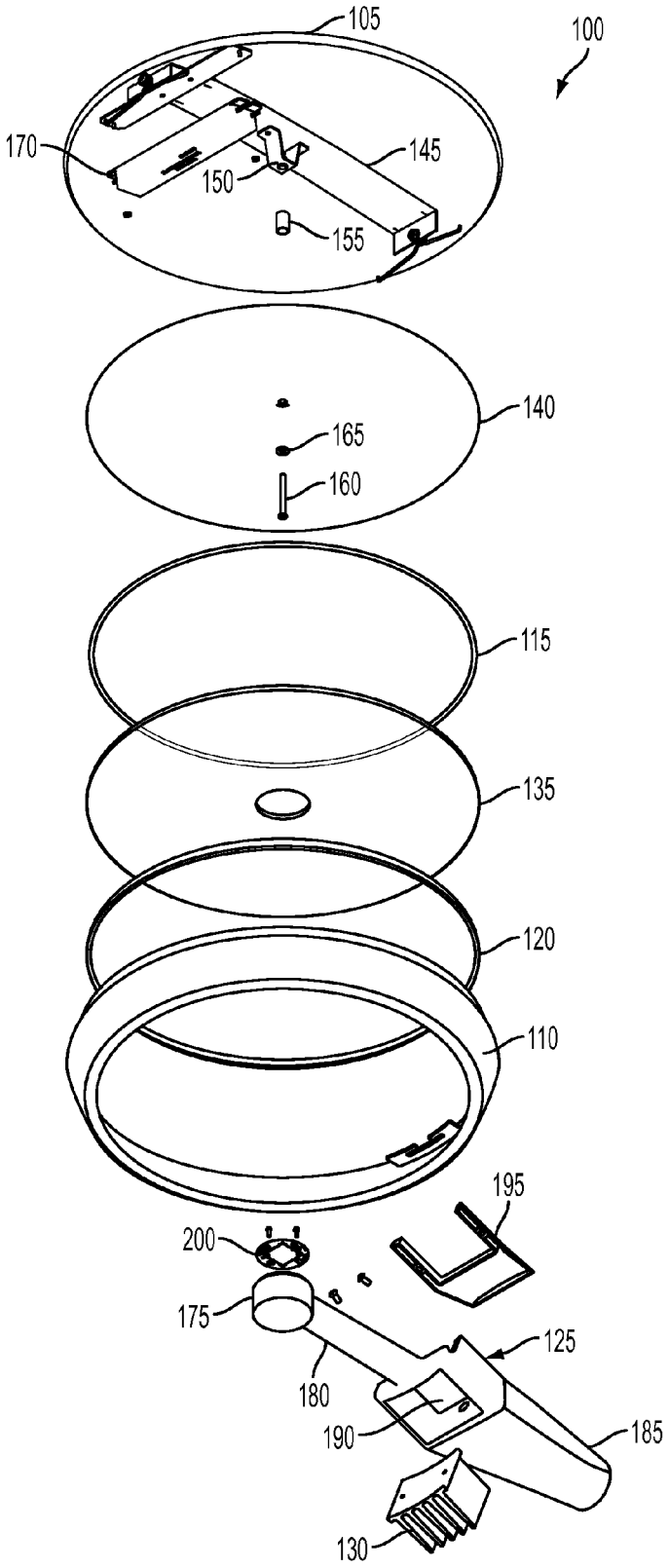
FIG. 2 is an exploded perspective view of a lighting device according to an embodiment of the present application.

FIG. 2 is an exploded view of the lighting device 100 according to an embodiment of the present application. As shown, the lighting device 100 can include a lens 135 disposed between the upper gasket 115 and the lower gasket 120 and adapted to direct or magnify light emitted from the lighting device 100. Also shown is a reflector 140 that can reflect light from the back side of the lighting device 100 through the lens 135 and into the desired illumination area. A bracket 145 can be disposed within the upper housing 105 and can act as a structural backbone of the lighting device 100. For example, the bracket 145 can include a coupling member 150 disposed near a center of the upper housing 105 and adapted to anchor the assembly of the lighting device 100 against the upper housing 105. For example, as shown, the coupling member 150 is coupled to a standoff 155, which in turn is coupled to a fastener 160 and a washer 165. Together, the standoff 155, fastener 160 and washer 165 can couple the lower housing 110, lower gasket 120, lens 135, upper gasket 115, and reflector 140 to the upper housing 105 through the coupling member 150.

A driver 170 can also be included in the upper housing 105 to control operation of the lighting device 100. For example, the driver 170 can control the times at which the lighting device 100 is illuminated, and the frequency or intensity at which the lighting device is illuminated. The driver 170 can also control output of power to lighting structures such as LEDs so as not to under-power or over-power the LEDs and cause a malfunction.

Figure 3:
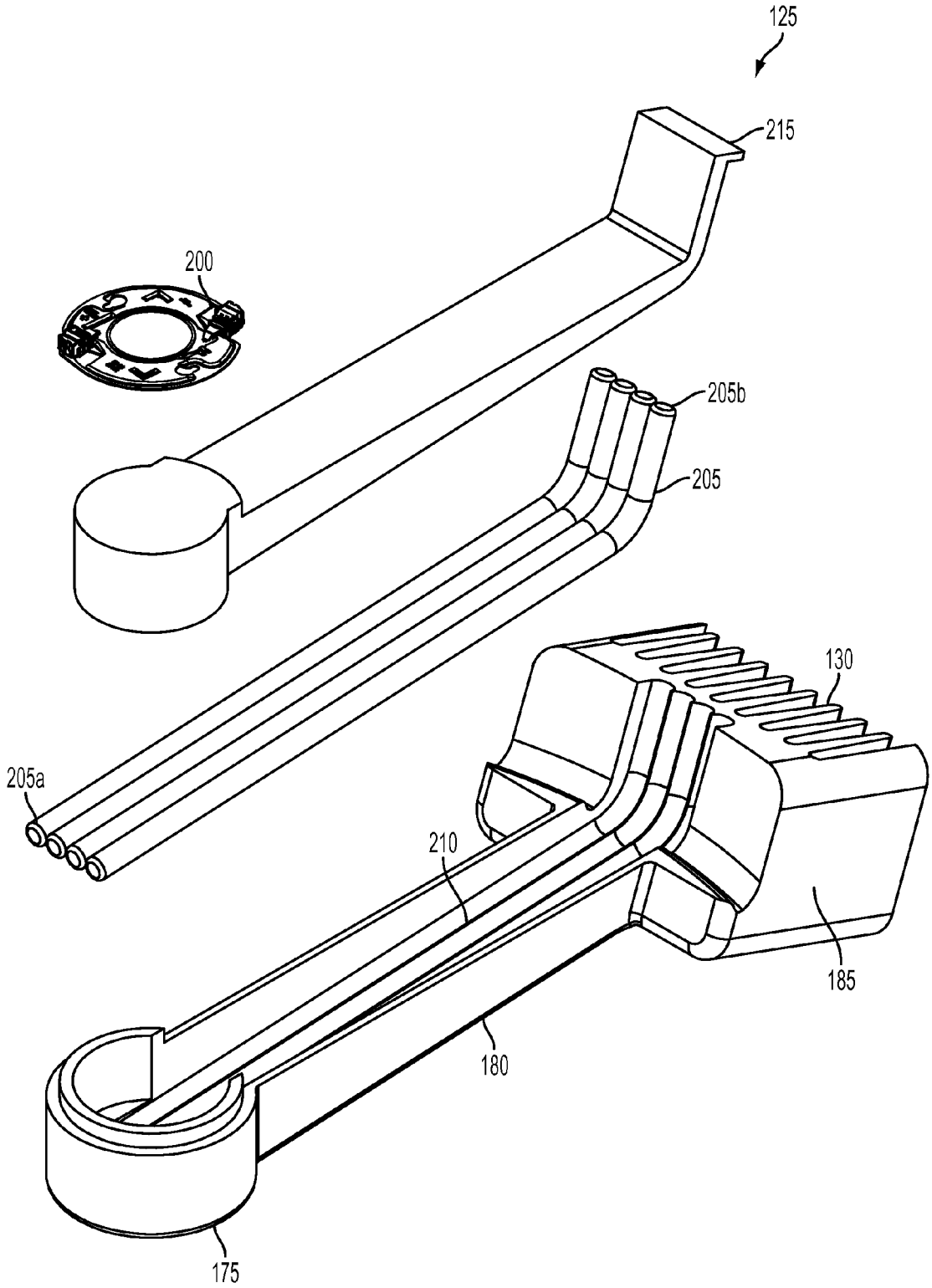
FIG. 3 is an exploded perspective view of a heat dissipation structure according to an embodiment of the present application.
Figure 4:
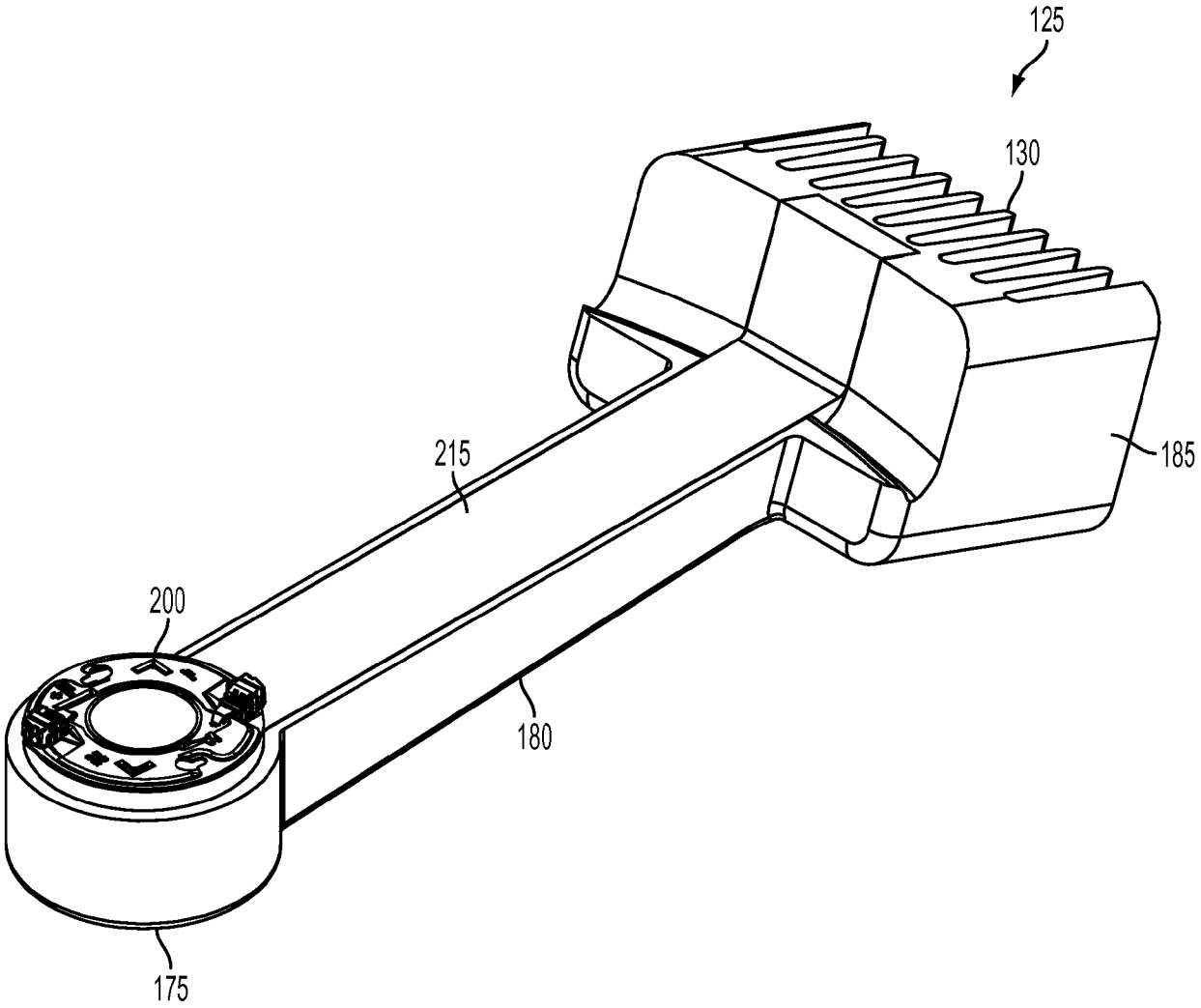
FIG. 4 is an assembled perspective view of a heat dissipation structure according to an embodiment of the present application.

The heat dissipation structure 125 will now be discussed with reference to FIGS. 2-4. As shown in FIG. 2, the heat dissipation structure 125 can include a heat sink 130 distally disposed relative to the light emitting structure 200 and adapted to dispense heat away from the light emitting structure 200 to the environment. The heat dissipation structure 125 can include a cap 175, an extension portion 180 extending from the cap 175, and a body 185 extending from the extension portion 180. The body 185 can optionally include an opening 190 adapted to receive the heat sink 130. Further, a plate 195 can enclose the body 185 or any other component of the heat dissipation structure 125. The light emitting structure 200 can be coupled to the heat dissipation structure 125 so heat can be dissipated from the light emitting structure 200 towards the heat sink 130 and ultimately away from the lighting device 100. For example, the heat dissipation structure 125 can include one or more heat conduits 205 having a linear portion 205*a* located proximate the light emitting structure 200 and adapted to dispense heat away from the light emitting structure 200, and towards an angled portion 205*b* extending from the linear portion 205*a* at an angle and located near the heat sink 130. The heat conduits 205 can be disposed within one or more groups 210 that can extend from the cap 175 through the extension portion 180 and to the body 185. A cover 215 can enclose the heat conduits 205 within the heat dissipation structure 125.

The upper housing 105 and lower housing 110 can be any structure that allows for a clamshell-type housing configuration. As shown, the upper housing 105 is circular shaped with an enclosed top portion, but any shape or size of the upper housing 105 can be implemented without department from the spirit and scope of the present invention. Similarly, the lower housing 110 is also circular in shape and defines an opening for the lens 135, so as to allow light to be emitted from the light emitting structure 200 and into the desired lighting area.

The upper gasket 115 and lower gasket 120 can be any composition and any shape to allow for a mechanical seal between the necessary components. For example, the upper gasket 115 can provide a seal between the reflector 140 and the lens 135. Similarly, the lower gasket 120 can provide a seal between the lens 135 and lower housing 110. The upper 115 and lower 120 gaskets can be made of any material, for example, silicon or rubber, and need not create an air-tight or liquid-tight seal.

The lens 135 allows light to be emitted away from the lighting device 100 and onto the illumination area. The lens 135 can be transparent and/or colored so long as light is allowed to pass through in some manner. The lens 135 can be made of any material, and in a preferred embodiment is made of clear acrylic.

The heat sink 130 can be any structure that dispenses heat away from the light emitting structure 200 to the environment. As shown, the heat sink 130 includes fins to increase the surface area of the heat sink 130 and allow more heat to dissipate from the lighting device 100. However, any structure or any material can be implemented as the heat sink 130 so long as the structure dispenses heat away from the lighting device 100.

The light emitting structure 200 can be any object or device that emits light. For example, the light emitting structure can be an LED, light bulb, fluorescent bulb, liquid crystal display (LCD), plasma screen, or any other device capable of emitting light. In a preferred embodiment, the light emitting structure 200 is an LED.

The heat conduit 205 can be made of any material and can be any structure that allows for the transfer of heat from the light emitting structure 200 towards the heat sink 130. As shown, the heat conduit 205 includes a linear portion 205*a* located proximate the cap 175, and accordingly, proximate the heat emitting structure 200, so as to receive the heat from the heat emitting structure 200. The heat conduit 205 can also include an angled portion 205*b* extending from the linear portion 205*a* and located proximate the heat sink 130. In this manner, the heat conduit 205 can transmit heat from the light emitting structure 200 towards the heat sink 130, and due to the greater surface area contact between the angled portion 205*b* and the heat sink 130, can transmit more of the heat away from the light emitting structure 200 and ultimately away from the lighting device 100. The heat conduit 205 can be tubular in nature, i.e., can be hollow inside, to allow for even greater surface area to dissipate heat. Also, the heat conduit 205 can include multiple heat conduits, and is not limited to a singular heat conduit 205.

The light emitting structure 200 can be coupled to the heat dissipation structure 125 at the cap 175, as shown. In this manner, the heat dissipation structure 125 can transfer the heat from the light emitting structure 200 towards an area of the lighting device 100 where spatial constraints are not as prevalent. This arrangement allows for the heat sink 130 to be disposed in a variety of different areas on the lighting device 100, therefore allowing greater variability in engineering the lighting device 100.

As discussed herein, the term "coupled" is intended to refer to any connection, direct or indirect, and is not limited to a direct connection between two or more elements of the disclosed invention. Similarly, "operatively coupled" is not intended to mean any direct connection, physical or otherwise, and is merely intended to define an arrangement where two or more elements communicate through some operative means (e.g., through conductive or convective heat transfer, or otherwise).

The matter set forth in the foregoing description and accompanying drawings is offered by way of illustration only and not as a limitation. While particular embodiments have been shown and described, it will be apparent to those skilled in the art that changes and modifications may be made without departing from the broader aspects of Applicant's contribution. The actual scope of the protection sought is intended to be defined in the following claims when viewed in their proper perspective based on the prior art.

What is claimed is:

1. A lighting device comprising:

a housing adapted to house a light emitting structure;

a reflector disposed within the housing and adapted to reflect light emitted from the light emitting structure; and a heat dissipation structure coupled to the housing and defining an opening, the heat dissipation structure including:

a heat conduit operatively coupled to the light emitting structure to receive heat therefrom; and a heat sink provided in the opening and operatively coupled to the heat conduit to receive the heat and dissipate the heat away from the light emitting device.

2. The lighting device according to claim 1, wherein the light emitting structure is a light emitting diode (LED).

3. The lighting device according to claim 1, further comprising a lens adapted to focus light reflected by the reflector.

4. The lighting device according to claim 3, further comprising upper and lower gaskets respectively disposed above and below the lens.

5. The lighting device according to claim 1, wherein the housing includes a first housing portion coupled to a second housing portion.

6. The lighting device according to claim 1, wherein the heat dissipation structure further includes a cap, a body, and an extension portion coupling the cap to the body, and wherein the heat conduit extends from the cap to the body.

7. The lighting device according to claim 6, wherein the light emitting structure is coupled to the heat dissipation structure at the cap.

8. The lighting device according to claim 6, wherein the heat conduit includes a linear portion and an angled portion extending from the linear portion at an angle.

9. The lighting device according to claim 8, wherein the linear portion is disposed proximate the light emitting structure and the angled portion is disposed proximate the heat sink.

10. The lighting device according to claim 6, further comprising a cover adapted to house the heat conduit within the heat dissipation structure.

11. The lighting device according to claim 1, wherein heat dissipation structure further includes a groove adapted to receive the heat conduit.

12. A heat dissipation structure for a light emitting device, comprising:

a cap;

an extension portion extending from the cap;

a body extending from the extension portion;

a heat conduit operatively coupled to the light emitting device and adapted to transfer heat away from the light emitting device;

a heat sink operatively coupled to the heat conduit and adapted to receive the heat from the heat conduit and dispense the heat away from the heat dissipation structure; and a heat dissipation structure defining an opening adapted to receive the heat sink.

13. The heat dissipation structure according to claim 12, further comprising a groove adapted to receive the heat conduit.

14. The heat dissipation structure according to claim 12, wherein the heat conduit includes a linear portion and an angled portion extending from the linear portion at an angle.

15. The heat dissipation structure according to claim 14, wherein the linear portion is disposed proximate the light emitting structure and the angled portion is disposed proximate the heat sink.

16. The heat dissipation structure according to claim 12, further comprising a cover adapted to house the heat conduit.

* * * * *